United States Patent [19]

Bosch

[11] 4,100,840

[45] Jul. 18, 1978

[54] RADIAL PISTON MACHINE

[75] Inventor: Paul Bosch, Ludwigsburg, Fed. Rep. of Germany

[73] Assignee: Robert Bosch GmbH, Stuttgart, Fed. Rep. of Germany

[21] Appl. No.: 742,125

[22] Filed: Nov. 15, 1976

[30] Foreign Application Priority Data

Nov. 22, 1975 [DE] Fed. Rep. of Germany ..... 2552442

[51] Int. Cl.[2] ..... F01B 13/06

[52] U.S. Cl. ..... 91/491; 91/498

[58] Field of Search ..... 91/491, 497, 498, 492

[56] References Cited

U.S. PATENT DOCUMENTS 2,813,492 11/1957 Berlyn ..... 91/498

3,690,789 9/1972 Spence ..... 417/203

3,961,562 6/1976 Kersten ..... 91/492

*Primary Examiner*—William L. Freeh

*Attorney, Agent, or Firm*—Michael J. Striker

[57] ABSTRACT

A radial piston machine in which a rotor with radial bores is rotatable on a trunnion integral with the machine housing. Pistons, preferably in the form of hollows balls, are respectively located in the bores of the rotor and moved during rotation of the latter along suction and compression strokes by engagement with a displacement ring eccentrically arranged with respect to the rotor axis. Channels in part formed in the trunnion serve for feeding pressure fluid in and out of the machine.

9 Claims, 7 Drawing Figures

RADIAL PISTON MACHINE

BACKGROUND OF THE INVENTION

The present invention relates to a radial piston machine provided with pistons, for instance spherical pistons, which are arranged in radial bores of a rotor and which are moved along suction and compression strokes by engagement with an annular surface eccentrically arranged with respect to the rotor axis, in which the rotor is mounted for rotation on a control trunnion in which channels for feeding pressure fluid into and out of the machine are provided.

In known radial piston machines of the aforementioned kind, the control trunnion is fixedly arranged in a bore of the housing. The pistons suck the fluid medium through at least one channel which extends in longitudinal direction through the control trunnion and displace the fluid through another channel, likewise extending in longitudinal direction through the trunnion to an outlet.

Such a machine has the disadvantage that it is difficult to produce, that it has a relatively great mass and that the suction characteristics of the machine are not very satisfactory.

SUMMARY OF THE INVENTION

It is an object of the present invention to provide a radial piston machine of the aforementioned kind which is simpler to manufacture than such machines known in the art and in which the suction characteristics of the machine are greatly improved over the suction characteristics of machines known in the art.

This object is obtained according to the present invention by constructing the control trunnion integral with the machine housing and by feeding the fluid medium from an inlet channel in transverse direction through the housing outwardly past the pistons, to a cover closing the housing on the side opposite the inlet channel and from there through channels in the cover to a suction slot formed in the control trunnion.

In this way a very simple and compact radial piston machine is derived, which can be manufactured at very reasonable cost and which has excellent suction characteristics.

The novel features which are considered as characteristic for the invention are set forth in particular in the appended claims. The invention itself, however, both as to its construction and its method of operations, together with additional objects and advantagages thereof, will be best understood from the following description of specific embodiments when read in connection with the accompanying drawings.

DESCRIPTION OF THE PREFERRED EMBODIMENTS

Figure 1:
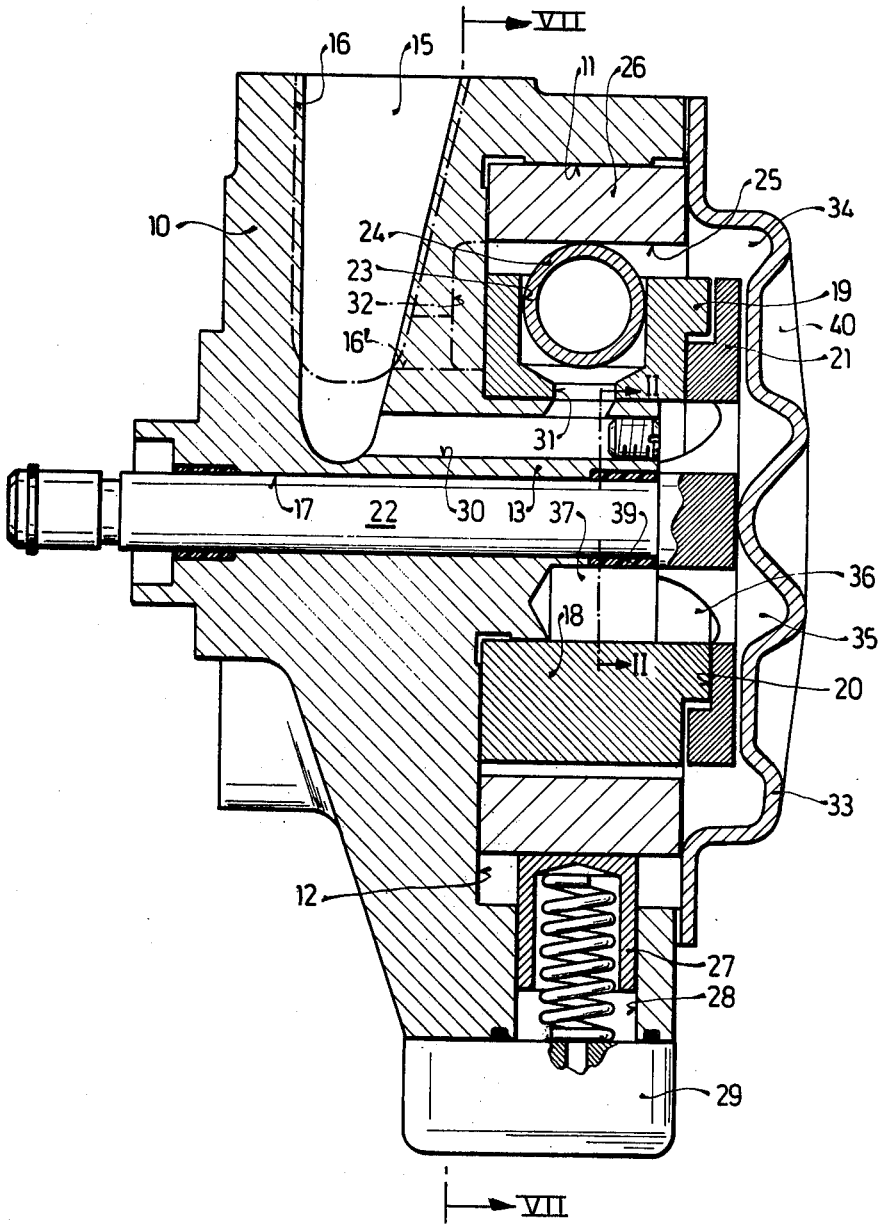
FIG. 1 is a longitudinal section through the radial piston machine according to the present invention.
Figure 2:
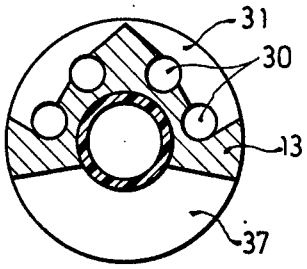
FIG. 2 is a cross-section taken along the line II—II of FIG. 1.

Referring now to the drawing, and more specifically to FIG. 1 of the same, it will be seen that the radial piston machine according to the present invention comprises a housing 10 formed at one side thereof with a cylindrical or prismatic cutout 11. The cutout 11 has a plane bottom 12 from which a control trunnion 13 projects integral with the housing.

An outlet channel 15 and an inlet channel 16 are formed adjacent each other in the housing and extend from the outer peripheral surface of the latter in substantial radial direction thereinto. The inner ends of these channels are located radially outwardly of an axial bore 17 extending through the housing 10 and the control trunnion 13. The inlet channel is indicated with dash-dotted lines since it is located in another plane than the outlet channel 15.

A rotor 18 is mounted with a minimum clearance on the control trunnion 13 for rotation about the axis thereof. The rotor 18 is provided on its right side, as viewed in FIG. 1, with a plurality of radially extending ridges 19 which engage into corresponding slots 20 of a coupling disc 21. The coupling disc is fixedly mounted on a shaft 22, which in turn, is mounted in the longitudinal bore 17 and which serves to drive the rotor 18, when the machine is operated as a pump.

Figure 5:
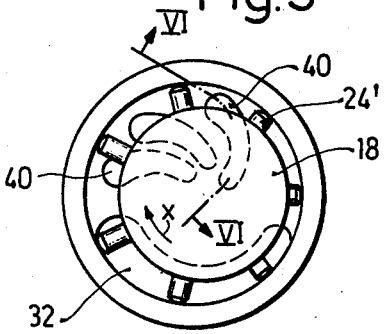
FIG. 5 schematically illustrates a modification of the embodiment shown in FIG. 1.

The rotor 18 is provided with a plurality of radially extending bores 23, having open inner and outer ends, in which pistons 24 are closely guided for movement in the axial direction of the bores. The pistons 24 are shown in FIG. 1 as hollow balls, but other pistons, for instance of cylindrical shape with rounded outer and inner ends, such as shown in FIG. 5 at 24', may also be used. The outer ends of the pistons 24 project outwardly beyond the outer peripheral surface of the rotor 18 and roll on a cam face 25 of a displacement ring 26, which is guided in the cutout 11 for movement transverse to its axis and which can be moved in this direction by a fluid-operated piston 27 which is closely guided in a bore 28 extending normal to the bore 17. Movement of the piston 27 is controlled by a control device 29, of known construction and only schematically shown in FIG. 1. It is to be understood that the displacement ring 26 is also engaged on the side opposite the piston 27 by at least one similar piston which, for simplification reason, is not shown in the drawing.

A plurality of bores 30, parallel to the axis of the central bore 17, extend from the outlet channel 16 through the control trunnion 13. The bores 30 communicate adjacent the right ends thereof, which are closed by plugs, with a cross-slot 31 extending to the peripheral surface of the control trunnion 13. The cross-slot 31 communicates with the bores 23 housing those pistons 24 which during rotation of the rotor 18 perform a radial inwardly directed compression stroke.

Figure 7:
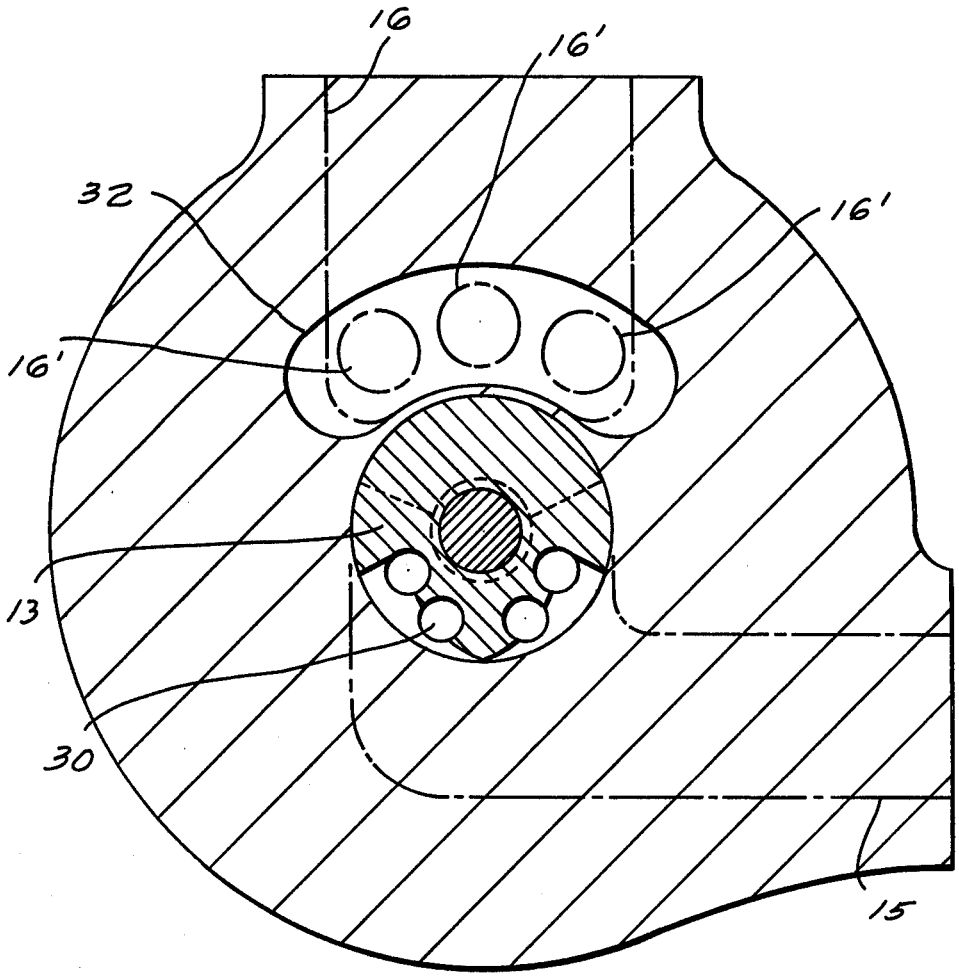
FIG. 7 is a section taken on line VII—VII of FIG. 1.

A short bore 16' likewise parallel to the longitudinal bore 17 leads from the inlet channel 16 to a substantially kidney-shaped cutout 32 (see FIG. 7) extending towards the left, as viewed in FIG. 1, from the bottom 12 of the cutout 11 and in radial direction at least up to the cam face 25 of the displacement ring 26. This cutout 32 extends in circumferential direction through a region in which the width of the gap between the peripheral surface of the rotor 18 and the cam face 25 increases in the direction of rotation of the rotor. The width of this cutout 32 in radial direction preferably increases in the direction of rotation of the rotor 18, indicated by the arrow *x* in FIG. 5.

The open end of the cutout 11 in the housing 10 is closed by a cover 33. The cover 33 is provided with an outer annular channel 34, an inner annular channel 35 and a plurality of connecting channels 40 providing communication between the outer and the inner annular channel. The outer annular channel 34 is arranged to communicate with the gap between the inner surface 25 of the displacement ring 26 and the outer peripheral surface of the rotor 18, whereas the inner annular channel 35 is arranged in the region of the axial passages 36 provided in the coupling disc 21, which in turn communicate with the suction slot 37 in the control trunnion 13. The suction slot 37 extends in circumferential direction nearly over half the circumference of the control trunnion 18 and in axial direction from the outer peripheral surface thereof nearly up to the longitudinal bore 17, that is up to a bearing 39 for the shaft 22. This suction slot communicates during rotation of the rotor 18 with the inner ends of those bores 23 in which the pistons 24 therein move, during rotation of the motor 18, in radial outwardly direction along their suction strokes.

Figure 6:
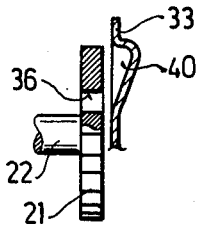
FIG. 6 is a cross-section taken along the line of VI—VI of FIG. 5.

The connecting channels 40 are of substantially spiral configuration, as indicated in FIG. 5, and the open cross-section thereof decreases in radial inward direction as can be visualized from FIGS. 5 and 6. While FIG. 5 shows only three of such connecting channels, it is to be understood that such connecting channels are provided uniformly spaced from each other in circumferential direction along the whole cover 33. The connecting channels 40 curve in such a direction to assure smooth flow of fluid medium from the inner ends of the channels through the inner annular channel 35 into the axial passages 36 in the coupling disc 21.

The above-described machine will, assuming the machine is used as a pump, operate as follows:

The drive shaft 22 drives over the coupling disc 20 the rotor 18 so that the pistons 24, which, due to the centrifugal force imparted thereto will engage the cam face 25 of the displacement ring 26, will perform, during rotation of the rotor suction strokes in radial outward direction and compression strokes in radial inward direction. During the radial outward suction strokes, the fluid medium will be sucked into the inlet channel 16 to pass through the bore 16' into the cutout 32 (FIG. 7) and from the latter in transverse direction through the gap between the inner surface 25 of the displacement ring 26 and the outer peripheral surface of the rotor 18 to the outer annular channel 34 in the cover 33 and then through the connecting channels 40 to the inner annular channel 35 in the cover. From the inner channel 35 the fluid medium will flow, through the axial passages 36 in the coupling disc 21, to the suction slot 37 and from there into the respective bores 23 in which the pistons 24 perform their suction stroke. The fluid medium thus filling the radial inward portions of the bores 23 is displaced therefrom, during the inward compression strokes of the pistons 24, through the cross-slot 31 into the bores 30 and passes from the latter into the outlet channel 15 to a non-illustrated consumer device.

By shifting the displacement ring 26 in a direction transverse to its axis, it is possible to change the amount of fluid delivered by the machine, if the latter is operated as a pump.

The suction characteristic of the machine is improved in that, the fluid ring in the gap between the rotor 18 and the displacement ring 26, kept in rotation by the pistons 24, is displaced out of this, in direction of rotation of the rotor, narrowing gap, into the connecting channels 40.

Figure 3:
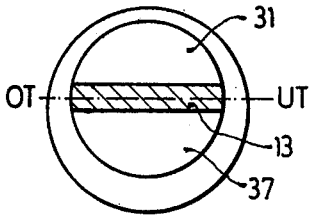
FIGS. 3 and 4 are schematic front views of the control trunnion.
Figure 4:
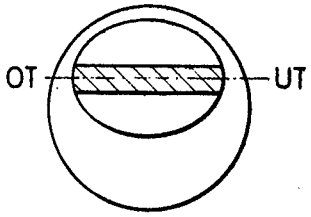

As shown in the schematic end view of FIG. 3, the control trunnion 13 may have in the plane of symmetry of the slots 31 and 37 a circular cross-section. FIG. 4 schematically illustrates an improved form of the control trunnion 13 which has in the region of the aforementioned plane an elliptical form, with the large axis of the ellipse extending through the dead-center plane indicated by the dash-lot line in FIGS. 3 and 4, in which "OT" indicates the upper and "UT" the lower dead-center position of the pistons. The outer circle in FIGS. 3 and 4 represents the inner peripheral surface of the rotor 18 and the clearance between the inner peripheral surface of the rotor and the outer peripheral surface of the trunnion 13 is shown in these two Figures in very exaggerated form.

It is also pointed out that the dead-center positions in FIGS. 2–5 are turned through an angle of 90° with respect to the dead-center position shown in FIG. 1.

The pistons may have substantially cylindrical form, as shown at 24' in FIG. 5, but preferably these pistons are in the form of hollow spherical bodies or balls as shown at 24 in FIG. 1. These hollow balls have a certain resiliency whereby the surface pressure between balls and the inner surface 25 of the displacement 26 are reduced so that higher fluid pressures may be used. Due to resiliency of the balls, the clearance between the balls 24 and the bores 23 in the rotor is also reduced with increasing pressure.

It will be understood that each of the elements described above, or two or more together, may also find a useful application in other types of radial piston machines differing from the types described above.

While the invention has been illustrated and described as embodied in a radial piston machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A radial piston machine comprising a housing having a control trunnion integrally formed therewith and an annular portion surrounding said control trunnion radially spaced therefrom to form an annular chamber open at one side; a cover closing the open side of said chamber; a rotor rotatably mounted on said control trunnion and having a plurality of radial bores having open inner and outer ends; a plurality of pistons respectively slidable in said bores and having outer ends projecting through said open outer ends of said bores beyond the outer periphery of said rotor; a displacement ring in said chamber eccentrically arranged with respect to said rotor and having an inner surface engaged by the outer ends of said pistons to move the latter during rotation of said rotor between suction and compression strokes, said inner surface of said displacement ring being radially spaced from the outer surface of said rotor and forming therewith a radial gap of varying height; an inlet channel in said housing on the side of said rotor opposite of said cover; passage means in said housing providing communication between said inlet channel and said gap; a suctions slot in said trunnion communicating during rotation of said rotor with the inner ends of those bores in which the pistons move radially outwardly along the suction stroke; a cross-slot in said trunnion opposite said suction slot and communicating during rotation of said rotor with the inner ends of those bores in which the pistons move radially inwardly along the compression stroke; an outlet channel in said housing; at least one bore through said trunnion substantially parallel to the axis thereof and providing communication between said cross-slot and said outlet channel; an axial bore in said trunnion and a shaft extending through said axial bore and with one end thereof beyond the housing at the side of the latter opposite said cover; coupling means at the other end of said shaft for coupling the shaft to the rotor, said coupling means comprising a coupling disc, and said rotor and said coupling disc being provided with interengaging radial slots and ridges, said coupling disc having axial passages permitting flow of fluid therethrough into said suction slot; and channel means in said cover and providing communication between said gap and said suction slot, said channel means comprising an outer annular channel in the region of said gap, an inner annular channel in the region of said axial passages in said coupling disc, and a plurality of connecting channels displaced circumferentially from each other and providing communication between said outer and said inner annular channel.

2. A radial piston machine as defined in claim 1, and including means engaging said displacement ring for changing the eccentricity thereof with respect to the axis of said trunnion.

3. A radial piston machine as defined in claim 1, wherein said control trunnion has in the region of the inner ends of said bores an elliptical cross-section and wherein the long axis of the ellipse is located in the dead-center plane of said pistons.

4. A radial piston machine as defined in claim 1, wherein said passage means in said housing comprise a substantially kidney-shaped cutout communicating with said gap and increasing in width in the direction of rotation of said rotor, and a bore providing communication between said inlet channel and said cutout.

5. A radial piston machine as defined in claim 4, wherein said cutout extends in circumferential direction through an angle in which the width of said gap increases in the direction of rotation of said rotor.

6. A radial piston machine as defined in claim 1, wherein said connecting channels are of spiral shape and bent at the radial inner ends in such a manner to insure smooth passage of a fluid from the inner ends thereof into said axial passages in said coupling disc.

7. A radial piston machine as defined in claim 6, wherein the open cross-section of each connecting channel decreases from its radially outer to its radially inner end.

8. A radial piston machine as defined in claim 1, wherein said pistons are in the form of balls.

9. A radial piston machine as defined in claim 8, wherein said balls are hollow.

* * * * *